US005363528A

United States Patent [19]

Brock

[11] Patent Number: 5,363,528

[45] Date of Patent: Nov. 15, 1994

[54] WINDOW WASHING TOOL

[76] Inventor: Roger D. Brock, 208 Fairhope Ave. #13, Fairhope, Ala. 36532

[21] Appl. No.: 188,696

[22] Filed: Jan. 31, 1994

[51] Int. Cl.[5] ..... A47L 13/12; A47L 1/06

[52] U.S. Cl. ..... 15/121; 15/245; 15/246

[58] Field of Search ..... 15/114, 118, 121, 220.1, 15/232, 245, 246

[56] References Cited

U.S. PATENT DOCUMENTS 1,818,917 8/1931 Wolf ..... 15/114

2,741,788 4/1956 Shey ..... 15/121

*Primary Examiner*—David A. Scherbel

*Assistant Examiner*—Randall E. Chin

*Attorney, Agent, or Firm*—Macdonald J. Wiggins

[57] ABSTRACT

A window washing tool includes a sponge-like applicator for applying water and cleaning fluid to a window and a resilient squeegee blade in a head portion of the tool. An elongate handle is attached to the head. A rear bar of a pair of hinged blade wiping bars is hingedly attached to the head portion to be moved from a rear retracted position to a forward position. A flexible tube is attached to a front wiping bar and extends along the handle. A knob at a distal end of the tube is operable to move the wiping bars from the rear retracted position to the forward position in which the wiping bars clamp on the edge of the squeegee bar, and to return the wiping bars to the retracted position, thereby absorbing and expressing cleaning fluid to provide a relatively dry squeegee blade for subsequent use.

8 Claims, 1 Drawing Sheet

WINDOW WASHING TOOL

BACKGROUND OF THE INVENTION

1. Field of the Invention

The present invention relates to a window washing tool, and more particularly to a washer having means for quickly and easily cleaning the wiper bar after each use.

2. Description of the Prior Art

Tools for cleaning windows and other flat glass surfaces are well known. A common tool may have an elongate handle having a transverse head. The head may have a sponge-like pad along one edge thereof, and a rubber-like squeegee blade along a second edge thereof. In use, the pad is immersed in water, or a soap and water solution, and the glass surface is coated with the solution by drawing the pad across the surface thereof. Subsequently, the squeegee blade is wiped across the wetted surface to remove the solution.

The edges of the squeegee blade quickly accumulates a film of the solution, thereby reducing the cleaning efficiency of the cleaning process. Thus, the user must stop periodically and wipe the blade with a suitable cloth or paper towel.

This problem has been approached in the prior art by Shey, in U.S. Pat. No. 2,741,788, who teaches the use of a squeegee blade that extends forward from an applicator head when in use. After using the blade to wipe the surface being cleaned, it is pulled back and across a cleaning element to remove moisture from the blade. The blade is spring loaded to permit the blade to return to its operative position. Other U.S. patents on window cleaning tools are U.S. Pat. No. 2,201,079 to Camden, and U.S. Pat. No. 4,604,802 to Sammelsson.

SUMMARY OF THE INVENTION

The window washing tool of the invention provides a support tube and handle having a cleaning head at a proximal end of the support tube. The head is attached transverse to the handle, and is essentially rectangular. One of the longer edges of the head is formed of a sponge-type material used to apply cleaning solutions to a glass surface. The opposing edge is a squeegee blade of rubber or the like for wiping the cleaning solution from the glass surface.

A pair of blade wiping bars is provided having cleaning pads on the faces of the bars. The bars are in a retracted position during application of the cleaning solution. After applying the cleaning solution to the glass surface, the head is reversed, and the squeegee blade used to wipe the solution from the glass surface. The problem that occurs with this action is that the cleaning solution collects on the blade and thus leaves solution traces on the glass surface. To prevent buildup of solution on the blade, the wiping bars are utilized.

The wiping bars are hingedly attached to a rear surface of the head. The hinge leaf attached to the wiping bars extends rearwardly from the head when in a retracted position. A flexible tube is pivotally attached to one of the wiping bars, and extends through the support tube and handle, extending from the distal end of the handle. A knob is provided on the tube end projecting from the handle.

During wiping of a glass surface with the squeegee blade, the knob is maintained in its retracted position and extends from the distal end of the handle. After wiping of a glass surface with the squeegee blade, the cleaning solution will collect thereon, reducing the efficiency of the wiping action. At this point, the knob on the flexible tube is pushed fully forward. This action causes the wiping bars to open and then close over the squeegee blade edge. Excess solution on the blade is absorbed and removed from the blade. The knob is then retracted, causing the bars to retract and close together. Excess fluid is thus expressed from the bars, preparatory for continuing cleaning of the glass surface.

It is therefore a principal object of the invention to provide a window washing tool for efficiently applying cleaning solutions to a glass surface, for removing such solutions from the surface, and for maintaining the removing portion of the tool in a relatively dry condition.

It is another object of the invention to provide a window washing tool having a cleaning solution applicator, a squeegee blade for removing the solution from a surface being cleaned, and a blade cleaner for quickly and easily removing solution collecting on the blade.

These and other objects and advantages of the invention will become evident from the following detailed description.

DETAILED DESCRIPTION OF THE PREFERRED EMBODIMENT

Figure 1:
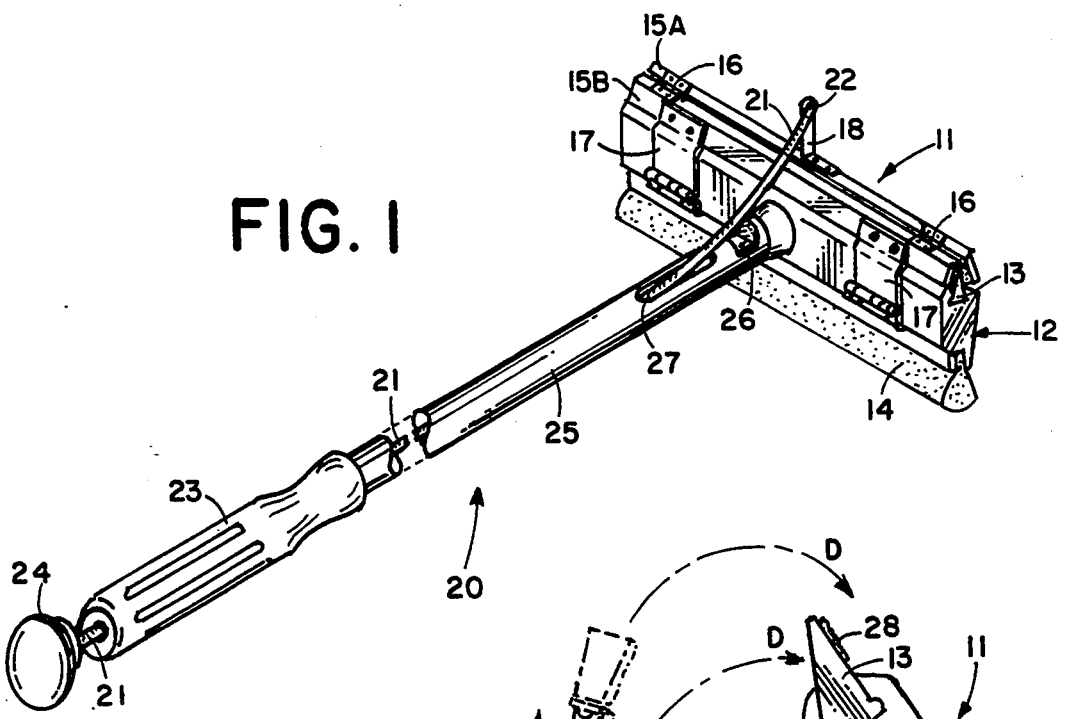
FIG. 1 is a perspective view of the window washing tool of the invention shown with cleaning bars in an extended position.

Referring to FIG. 1, window washing tool 10 is shown having washing head 11, and handle assembly 20. Handle assembly 20 includes a tubular handle support tube 25, shown cut away to indicate that it may be any desired length. For example, the tool 10 may be used for cleaning automobile windshields and the like, in which case handle 20 may be relatively short. For use in washing building windows, handle 25 may be long enough to reach high windows. Handle grip 23 is provided at a distal end of tubular support tube 25.

Washing head 11 includes a squeegee body 12 which preferably may be formed from plastic, although other materials may be suitable. Body 12 is preferably rectangular in shape, and has a longitudinal edge thereof formed to grip a washing pad 14. Pad 14 is formed of any sponge-like material such as plastic foam or the like. The opposite edge comprises a rubber-type squeegee blade 13 attached to squeegee body 12. A thin sponge pad 28 is attached along a forward facing edge of blade 13, as best seen in FIG. 2.

Head 11 is attached to the proximal end of handle support tube 25. A pair of squeegee blade wiper bars 15A and 15B is shown in FIG. 1 clamped onto squeegee blade 13. Bars 15A and 15B are hinged together by hinges 16. As best shown in FIG.2, a sponge strip 30 is attached along the length of each wiper bar 15A and 15B. A bracket 18 is mounted on the upper edge of forward wiper bar 15A in FIG. 1. A proximal end of a wiper bar actuator tube 21 is pivotally connected to the distal end of bracket 18 by pivot pin 22. Actuator tube 21 is preferably formed from flexible plastic tubing, although a steel wire or the like may be suitable. Actuator tube 21 extends through a slot 27 of support tube 25, and extends through support tube 25 and handle 23. An actuator knob 24 is attached to the distal end of actuator tube 21. First leaves of a pair of hinges 17 are attached to a rear surface of squeegee body 12 and second leaves thereof are attached to wiper bar 15B.

Figure 2:
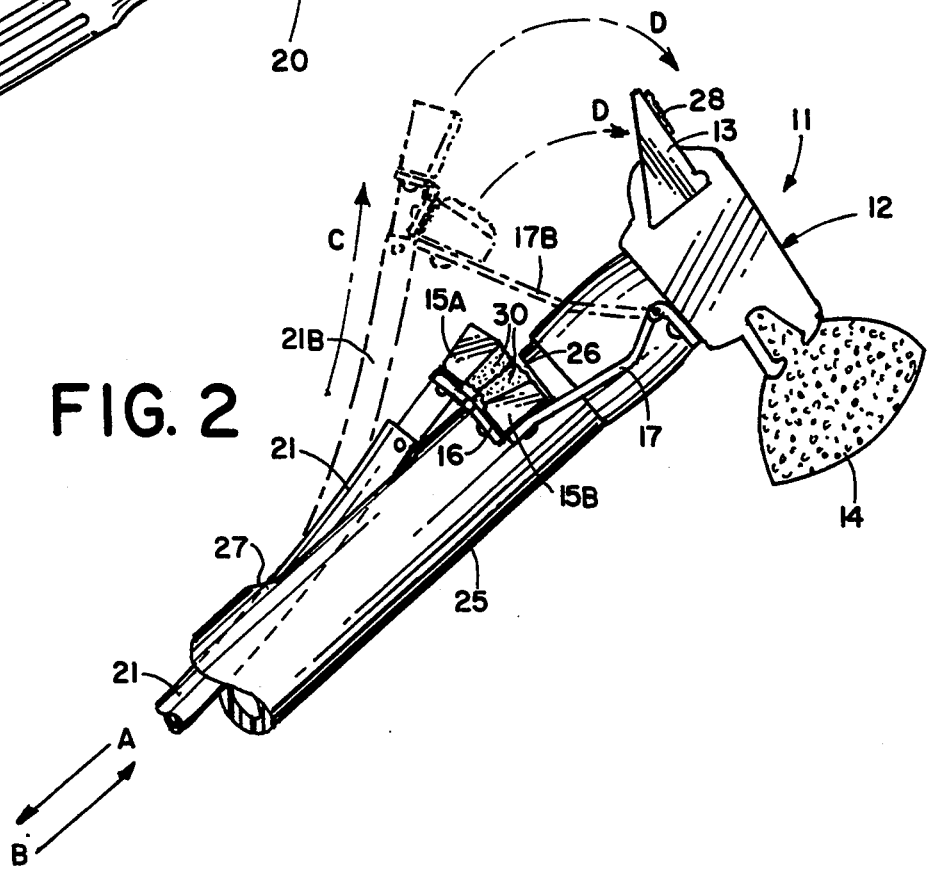
FIG. 2 is a partial side view of the tool of FIG. 1 with the cleaning bars in a retracted position.

Turning now to FIG. 2, a partial side view of window washer tool 10 is shown. Wiper bars 15A and 15B are shown in the retracted position, resting in a slot 26 in support tube 25. Retraction is accomplished by drawing knob 24 of FIG. 1 rearward as shown by arrow A. Pushing knob 24 forward as shown by arrow B causes actuator tube 21 to move as shown by arrow C with tube 21 shown in phantom view. This action moves wiper bar 15A, 15B towards blade 13. As shown by arrows D, pushing knob 24 fully forward, bars 15A, 15B clamp on squeegee blade 13 as shown in FIG. 1 to absorb solution therefrom.

Having described the construction of tool 10 of the invention, the operation will be explained. The normal operative position of the tool is shown in FIG. 2 with wiper bars 15A, 15B retracted. Squeegee pad 14 of head 11 is dipped in the water-soap mixture being used. The operator then applies squeegee pad 14 to the surface being cleaned. After cleaning a desired area of surface, head 11 is reversed, and the surface scraped by squeegee blade 13 to wipe the solution therefrom. As in the prior art, blade 13, at this point will be coated by the solution, inhibiting efficient squeegee action on subsequent use of the squeegee. The operator pushes knob 24 forward as indicated by arrow B of FIG. 2, causing wiper bars 15A, 15B to move as shown by arrows C and D. As bars 15A, 15B clamp onto blade 13, as shown in FIG. 1, will cause excess solution on blade 13 to be absorbed by pads 30. Pressure forward and on knob 24 will express moisture from pads 30.

Preparatory to the next washing cycle, the operator retracts wiper bars 15A, 15B as seen in FIG. 2. Continuing rearward drawing of knob 24 causes pads 30 to be squeezed together, expressing additional amounts of absorbed solution.

As an alternative embodiment of the above described construction, a single wiper bar 15B may be used with bracket 18 attached thereto. This modification would permit the major portion of cleaning solution, which collects on the rear surface blade 13, to be removed.

As will now be recognized, the invention provides an improvement over prior art window washing tools of the type shown to permit cleaning of glass surface and the like to be accomplished more efficiently and quickly. Although a particular embodiment of the invention has been shown, various modifications of the window washing tool may be made without departing from the spirit and scope of the invention.

I claim:

1. A window washing tool comprising:

a) a squeegee head having a body, an absorbent washing pad attached to a first portion of said body, and a squeegee blade having a front and rear face, and attached to a second portion of said body;

b) an elongate handle having a proximal end thereof attached to said body;

c) a pair of opposed wiping bars hinged together and disposed transverse to said handle, each of said bars having an absorbent pad attached thereto, and one of said pair of wiping bars pivotally attached to said squeegee head body; and d) means for moving said wiping bars from a rearward retracted position to a forward extended position in which said pads contact said front and rear faces of said squeegee blade respect.

2. The tool as defined in claim 1 in which said washing pad serves to absorb a washing solution, and to apply such solution to a surface to be washed.

3. The tool as defined in claim 2 in which said squeegee blade serves to remove said washing solution from said surface.

4. The tool as defined in claim 1 in which said means for moving said wiping bars includes an actuator rod pivotally attached to one of said wiping bars, said rod extending along said handle, and having an actuator knob attached to a distal end thereof, whereby pulling said knob serves to move said wiping bars to said rearward retracted position, and pushing said knob serves to move said wiping bars to said forward extended position in which said absorbent pads contact said front and rear faces of said squeegee blade respectively.

5. The tool as defined in claim 4 in which said absorbent pads contact said squeegee blade in said extended position to permit said pads to absorb and express cleaning solutions therefrom, and said pads are closed together in said retracted position to thereby express additional amounts of said absorbed solutions therefrom.

6. The tool as defined in claim 4 in which said actuator rod is formed by a flexible tube, said flexible tube is passed through a longitudinal slot in said support tube, and extends through said handle grip.

7. The tool as defined in claim 1 in which said handle comprises a support tube at the proximal end thereof and a handle grip at the distal end thereof.

8. A window washing tool comprising:

a) a squeegee head having an essentially rectangular body, an absorbent washing pad attached to a first longitudinal edge of said body, and a squeegee blade attached to a second longitudinal edge of said body;

b) an elongate handle comprising a support tube, the proximal end thereof attached to said body, and a tubular handle grip at the distal end of said support tube;

c) a pair of opposing wiping bars hinged together and disposed transverse to said support tube, one of said pair of wiping bars pivotally attached to a rear surface of said squeegee head body, and each of said bars having an absorbent pad attached thereto;

d) an actuator rod formed by a flexible tube, said flexible tube passes through a longitudinal slot in said support tubes and extending through said handle grip, said actuator rod having a proximal end thereof pivotally attached to one of said wiping bars, said rod extending through said support tube and handle grip;

e) an actuator knob attached to a distal end of said actuator rod, whereby pushing said knob moves said actuator rod from a retracted position to an extended position in which said pads contact a front and a rear face of said squeegee blade, respectively, permitting said pads to absorb and express cleaning solutions therefrom, and pulling said knob moves said actuator rod from the extended position to the retracted position whereby said pads are squeezed together to thereby express additional amounts of said absorbed solutions therefrom.

* * * * *